US007261043B2

(12) United States Patent
Cummings

(10) Patent No.: US 7,261,043 B2
(45) **Date of Patent: *Aug. 28, 2007**

(54) ARTICULATED RAILWAY BOGIE CONNECTOR

(75) Inventor: Douglas Gordon Cummings, Coal Point NSW (AU)

(73) Assignee: Bradken Resources PTY Limited, Mayfield West (AU)

( * ) Notice: Subject to any disclaimer, the term of this patent is extended or adjusted under 35 U.S.C. 154(b) by 0 days.

This patent is subject to a terminal disclaimer.

(21) Appl. No.: 10/410,932

(22) Filed: Apr. 10, 2003

(65) Prior Publication Data

US 2004/0020400 A1 Feb. 5, 2004

(30) Foreign Application Priority Data

Apr. 10, 2002 (AU) ..... PS1656

(51) Int. Cl.
*B61F 5/00* (2006.01)

(52) U.S. Cl. ..... 105/4.1; 105/199.3

(58) Field of Classification Search ..... 125/3, 125/4.1, 4.2, 182.1, 185, 190.1
See application file for complete search history.

(56) References Cited

U.S. PATENT DOCUMENTS 4,867,071 A * 9/1989 Weber ..... 105/4.1
5,000,096 A * 3/1991 Urrea et al. ..... 105/4.1
5,172,820 A * 12/1992 Daugherty, Jr. ..... 213/75 R
5,456,185 A * 10/1995 Rother et al. ..... 105/3
5,615,786 A * 4/1997 Hoyon et al. ..... 213/75 R
7,025,002 B2 * 4/2006 Cummings ..... 105/4.1

* cited by examiner

*Primary Examiner*—S. Joseph Morano
*Assistant Examiner*—Robert J. McCarry, Jr.
(74) *Attorney, Agent, or Firm*—Timothy J. Keefer; Seyfarth Shaw LLP

(57) ABSTRACT

An articulated railway bogie connector 10 is shown comprising a male connector component 12 and a female connector component 14. The articulated connector 10 is adapted to pivotally mount to a bolster 54 of a railway bogie 50. The male and female connector components 12, 14 are arranged to be welded to a skeletal body of adjacent railway wagons. The male and female connector components 12, 14 each include a pair of constant contact sidebearer outrigger brackets and associated wear plates located. The outrigger brackets such as 16A/B are in the form of a pair of wing members cast integral with and extending laterally of the male connector component 12. However the wing members such as 16A/B may be welded or otherwise formed integral with, in this instance, the male connector component 12. The outrigger brackets or wing members 16A/B and 18A/B are adapted for fixing of a wear plate which is arranged in use to contact corresponding constant contact sidebearers mounted to the articulated bogie 50.

20 Claims, 4 Drawing Sheets

ARTICULATED RAILWAY BOGIE CONNECTOR

FIELD OF THE INVENTION

The present invention relates generally to an articulated railway bogie connector.

BACKGROUND TO THE INVENTION

Articulated railway freight trains where adjacent wagons are mounted at adjacent ends to an interconnecting railway bogie are known. The bogie includes a pair of side frames spaced apart by a bolster on which the wagons are mounted via an articulated connector. The articulated connection is provided by mating male and female components of the articulated connector which are respectively welded into the sill of adjacent wagons. Sidebearer support brackets are either cast or welded/fabricated separate of the bolster and thereafter welded or bolted to the bolster.

Adjacent ends of the wagons in an articulated railway freight train also include mountings for sidebearer wear plates which in use contact corresponding constant contact sidebearers mounted on the bogie bolster. In U.S. Pat. No. 4,233,909 wagon-mounted mountings for sidebearer wear plates are shown as very large support arms extending from the wagon ends.

SUMMARY OF THE INVENTION

In a first aspect the present invention provides an articulated railway bogie connector comprising:

a male connector component adapted for mounting to an end of a railway wagon and including two outrigger brackets, each adapted for fixing of a wear plate; and a female connector component being arranged for mating with the male component, the female component adapted for mounting to an end of an adjacent railway wagon and including another two outrigger brackets, each adapted for fixing of another wear plate, the wear plates adapted for contacting corresponding constant contact sidebearers mounted to a railway bogie to which the male and female connector components are pivotally mounted.

One advantage of including the outrigger brackets on the male and female connector components is that the need is obviated for large, long and heavy support arms fitted with outrigger brackets extending from the wagon ends. Consequently the overall weight of the rail wagons when used with the articulated connector of the invention can be lighter, and the construction of those rail cars themselves simplified.

Preferably the outrigger brackets are integral with the male and/or female connector components. More preferably the outrigger brackets are cast, welded or otherwise formed integrally with said components. By having integral brackets cast as part of the connector components, these components have a greater inherent strength compared with prior art arrangements, and the connector components can be made of thinner material and can therefore be lighter overall. If a cast connector component is made, because no joining or welding is required, the component can also be simpler and cheaper to make because of the reduced number of manufacturing steps compared with a welded product. For example, the cast components can be cast in a single step. However it is within the scope of the invention for the connector components to be formed by processes other than casting.

Preferably the outrigger brackets are each in the form of a pair of wing members extending laterally of the respective connector components. Preferably in plan view of the bogie connector and with reference to a central rotational point between the male and female connector components, each wing member is arranged to provide radial alignment between the mutually contacting wear plates and constant contact sidebearers.

Preferably in plan view of the bogie connector, and with reference to a radius from a central rotational point between the male and female connector components, each wing member is arranged to be lengthwise transverse to the radius. More preferably each wing member has a longitudinal axis of symmetry which is orthogonal to the radius.

Preferably the male and/or female connector components together with the respective outrigger bracket are at least in part hollow. More preferably the connector components are hollow to permit routing of pneumatic/hydraulic lines and/or electrical cable which is run internally of a centre sill of the railway wagon to which the connector component is mounted.

Preferably the connector components include one or more openings in side walls of the components to provide access for maintenance and to further reduce the weight of the components.

Preferably the male and/or female connector components are each adapted to be welded to a skeletal body of the railway wagon.

In a second aspect the present invention provides an articulated railway bogie connector comprising:

a male connector component adapted for mounting to an end of a railway wagon and associated with two brackets, each adapted for fixing of a wear plate; and a female connector component being arranged for mating with the male component, the female component adapted for mounting to an end of an adjacent railway wagon and associated with another two brackets, each adapted for fixing of another wear plate, the wear plates adapted for contacting corresponding constant contact sidebearers mounted to a railway bogie to which the male and female connector components are pivotally mounted, wherein, when viewed in plan, each bracket has a longitudinal axis of symmetry which is orthogonal to a radius from a central rotational point of the articulated railway bogie connector.

An advantage of an articulated connector having wear plate support brackets arranged orthogonal to a radial line extending the from central rotation point of the articulated connector is that the stability afforded by the sidebearers when in contact with these brackets and wear plates can be maximised as the articulated connector/s of one or more adjacent railway wagons rotate about the rotational point in use, for example when the wagons negotiate a curve which causes wagon body lean. Such an orthogonal alignment in use reduces the shear and maximises the sliding action between an aligned sidebearer and a wear plate located on the connector bracket because the relative movement therebetween is along the longitudinal axis of symmetry of the wear plate and bracket, thus making it easier for the wagon to rotate and the rotation more stable.

Preferably the articulated railway bogie connector of the second aspect is otherwise as defined in the first aspect.

BRIEF DESCRIPTION OF THE DRAWINGS

In order to facilitate a better understanding of the nature of the present invention a preferred embodiment of an articulated railway bogie connector will now be described in some detail, by way of example only, with reference to the accompanying drawings in which.

DETAILED DESCRIPTION OF THE PREFERRED EMBODIMENT

Figure 1:
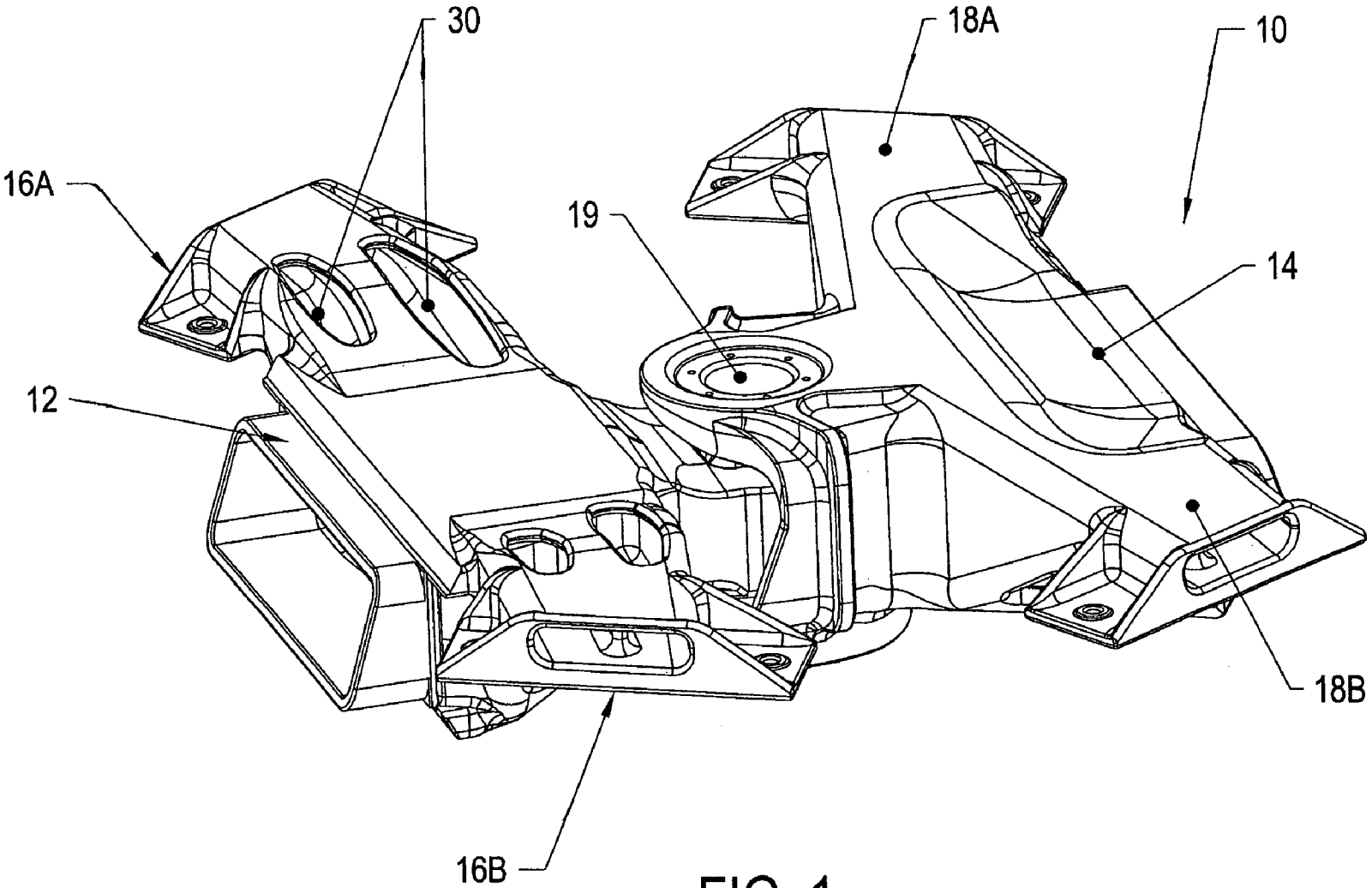
FIG. 1 is a perspective view of an articulated railway bogie connector in accordance with the invention.
Figure 2:
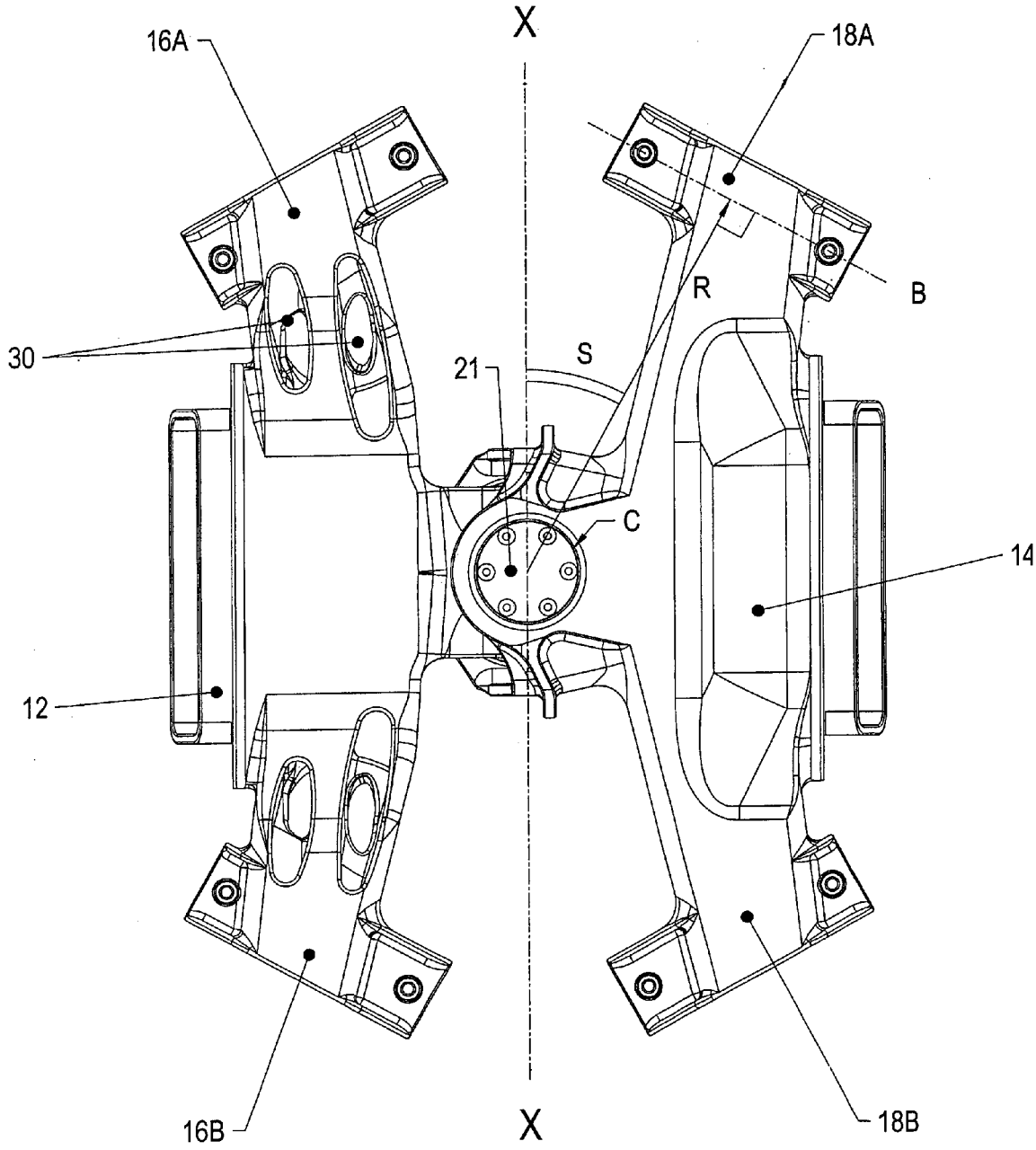
FIG. 2 is a plan view of the articulated connector of FIG. 1.
Figure 3:
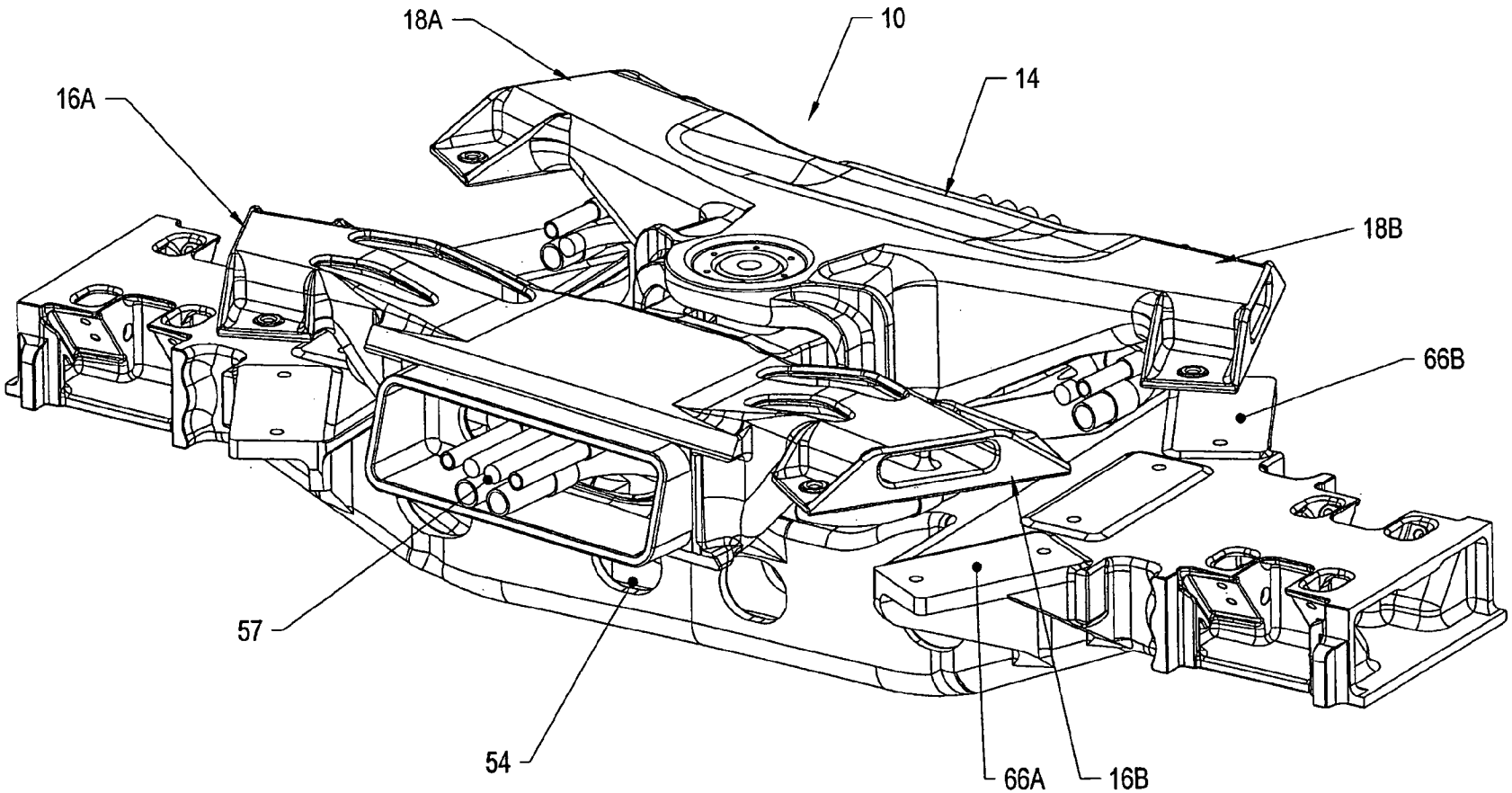
FIG. 3 is a perspective view of the articulated connector of FIG. 1 together with a bolster of an articulated railway bogie.

As shown in FIGS. 1 to 3 there is an articulated railway bogie connector 10 comprising a male connector component 12 and a female connector component 14. The articulated connector 10 is adapted to pivotally mount to a bolster 54 of a railway bogie 50 such as that illustrated in FIGS. 3 and 4. In this preferred example, the male and female connector components 12 and 14 are arranged to be welded to a skeletal body of adjacent railway wagons (not depicted).

The railway bogie 50 of FIGS. 3, 4*a*, 4*b* and 4*c* includes a pair of side frames such as 52 spaced apart by a bolster 54. The side frames 52 are each trapezium-shaped and at their opposing ends include a pair of respective pedestal legs which define downwardly facing pedestal jaws 56A and 56B. The pedestal jaws 56A/B provide mounting for respective bearings 58A/B to which an axle/wheel set 60A/B is rotationally mounted. The bolster 54 is sprung mounted at its opposing ends within each of the respective side frames such as 52 and provides for articulated mounting of adjacent railway wagons (not shown) via the articulated connector of FIGS. 1, 2 and 3.

Figure 4C:
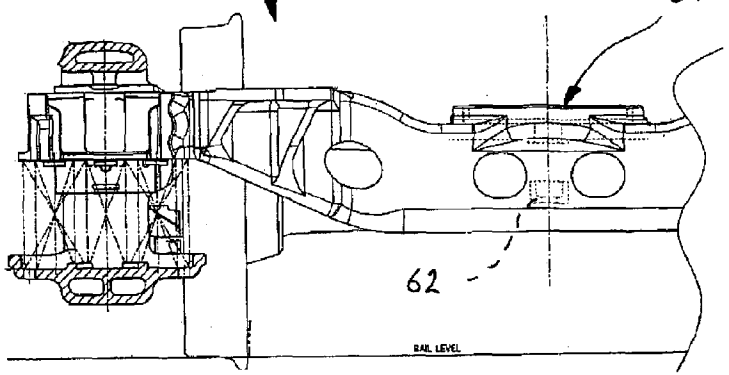
FIG. 4*c* is the bogie of FIG. 4*a* shown in part end elevational view.
Figure 4A:
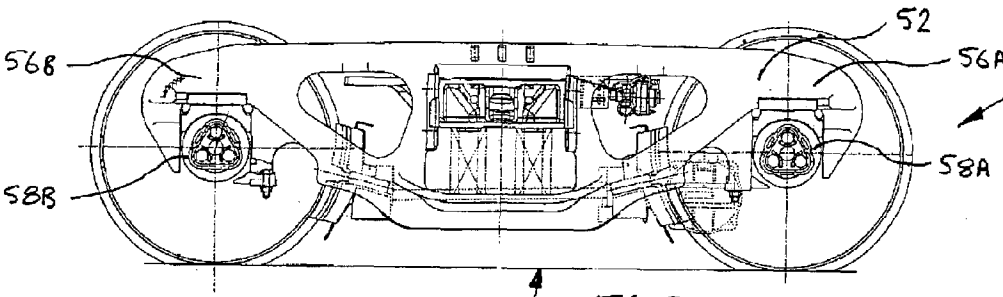
FIG. 4*a* is an articulated railway wagon bogie, the bogie shown in side elevation.

As shown in the hidden detail of the part end view of FIG. 4*c*, the bolster 54 includes a centre pin block 62 which is cup-shaped and aligned with an aperture in a centre bowl 64 of the bolster 54. The articulated connector 10 is pivotally mounted to the bolster 54 via a centre pin (not depicted) which passes through aligned holes in the articulated connector 10 and the centre bowl 64 and centre pin block 62.

In this embodiment of the invention the male and female connector components 12/14 of the articulated connector 10 each include a pair of constant contact sidebearer outrigger brackets and associated wear plates located on each of the male connector component 12 and female connector component 14. The outrigger brackets 16A/B are formed integral with the corresponding male connector component 12, and the outrigger brackets 18A/B are formed integral with the corresponding female connector component 14. In this particular construction the outrigger brackets such as 16A/B are in the form of a pair of wing members cast integral with and extending laterally of the male connector component 12. However, it should be appreciated that the wing members such as 16A/B may be welded or otherwise formed integral with, in this instance, the male connector component 12. The outrigger brackets 18A/B of the female connector component 14 are similarly in the form of a pair of wing members extending laterally of the female connector component 14. The outrigger brackets or wing members 16A/B and 18A/B are adapted for fixing of a wear plate (not depicted) which is arranged in use to contact corresponding constant contact sidebearers mounted, in this example, to the articulated bogie 50 of FIGS. 3 and 4*a-c*.

The female connector component 14 includes a circular-shaped recess 19 which is coaxial with the centre pin of the aligned holes in the articulated connector 10. A centrepin retention plate 21 is shown in FIG. 2 and is seated in use within the recess 19 and screwed to the female component 14.

The constant contact sidebearer outrigger brackets of the articulated connector 10 are radially aligned with corresponding constant contact sidebearer brackets connected to the bolster 54 of the bogie 50. In the preferred example, the sidebearer brackets of the bolster 54 are cast integral with the bolster 54 although it is possible that the bolster sidebearer brackets may be fastened or otherwise mounted to the bolster 54. In the preferred embodiment, the sidebearers are in the form of a pair of flanged outstands 66A/B disposed either side of and laterally extending from the bolster 54. The flanged outstands 66A, 66B are adapted to provide mounting for the respective constant contact sidebearers which are radially aligned with the corresponding wear plates fitted to the respective outrigger brackets 16B and 18B of the articulated connector 10.

Figure 4B:
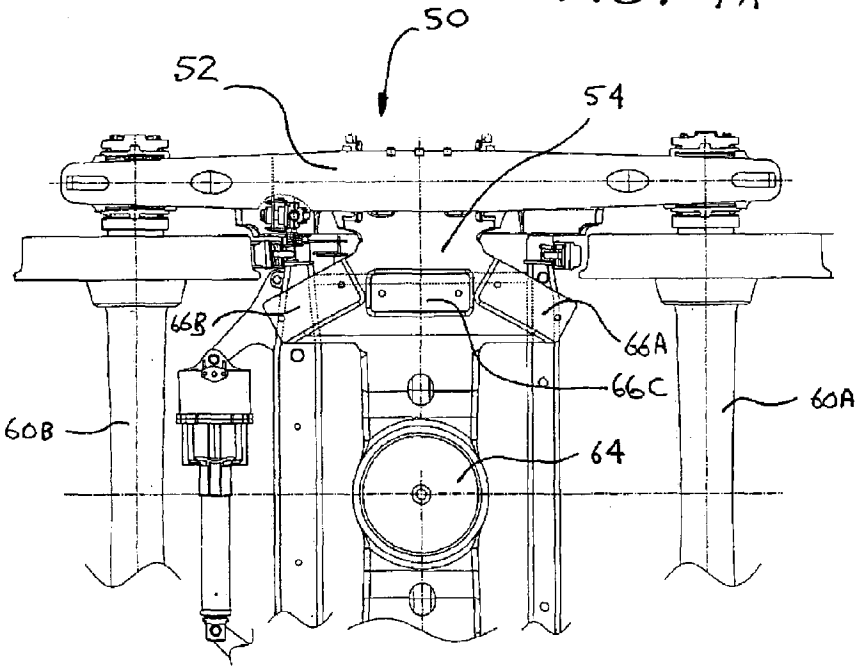
FIG. 4*b* is the bogie of FIG. 4*a* shown in part plan view.

In one embodiment, shown in FIG. 4*b*, there is a further support for a constant contact sidebearer in the form of a bracket 66C being integral with the bolster 54 and located between the bracket pair 66A/B. The bracket 66C is also adapted for fixing of a constant contact sidebearer (not illustrated) which may be fitted in some situations in addition to or as an alternative to the angled brackets 66A/B, for example at the end wagon of a wagon train if there is no adjoining wagon (a headstock bogie).

The constant contact sidebearers used with the articulated connector of the invention are a proprietary item which can be purchased commercially and are well known in the art, for example that manufactured by Stucki Co, USA. These bearers usually include a roller and a rubber spring component arranged in a housing. The use of any suitable type of constant contact sidebearer is within the scope of the invention.

One advantage of connector components having integral outrigger brackets is that the inherent strength of the articulated connector is increased. The connector components can thus be made overall of thinner material and can therefore be lighter.

By having outrigger brackets which laterally extend from the male and female connector components 12/14, the distance by which the wear plates mounted thereon and the constant contact sidebearers are spaced from the central rotational point C of the articulated connector is able to be increased compared with some prior art arrangements. This increased spacing between the rotational point C and sidebearers can increase the stability afforded by the sidebearers as the articulated connector of adjacent railway wagons rotates in use, for example when the wagons negotiate a curve which causes wagon body lean. In the preferred embodiment, the outrigger brackets can be arranged to laterally extend from the connector components so that the brackets can typically be oriented 30-45 angle degrees from the axial centreline X of the connector 10. When the brackets are widely spaced apart, this further increases the stability afforded by the sidebearers.

The male and female connector components 12, 14 in this example are cast as hollow structures. This permits routing of pneumatic/hydraulic lines and/or electrical cable 57 which may be run internally of, for example, the respective centre sill of the railway wagon to which the articulated member 10 is mounted. Such line and cable routing affords greater protection from damage than provided in current apparatus in which such lines/cables are generally exposed in the region spanning the rail wagons at or adjacent the known types of articulated connectors. The articulated connector 10 is generally welded to the centre sill or another section of the skeletal body of the adjacent railway wagons (not illustrated).

The male 12 and female 14 connector components also can include one or more openings or access holes 30. These access holes 30 provide access internally of the hollow connector components 12, 14 which may, for example, be beneficial in maintenance and servicing of these components 12, 14 as well as reducing the overall weight of the components without compromising their strength.

In operation, the articulated connector 10 is pivotally mounted to the bolster 54 of the railway bogie 50 and the outrigger brackets 16A/B and 18A/B and their corresponding wear plates radially aligned with the corresponding contact sidebearers of the railway bogie 50. In this instance the constant contact sidebearers of the railway bogie 50 are located at integral brackets such as 66A/B of the bolster 54. As a result of the radial alignment with the corresponding outrigger brackets and wear plates, contact is maintained during articulation of the adjacent wagons and the articulated connector 10. Referring to FIG. 2, when the connector 10 is viewed in plan, the radial line R shown extending from a central rotational point C between the articulated connector components 12/14 is orthogonal to a line B which represents the axis of symmetry of the outrigger bracket 18A. The advantage of this orthogonal position is that the stability afforded by the sidebearers when in contact with the outrigger brackets can be maximised when the wagons negotiate a curve which causes wagon body lean. The orthogonal alignment of sidebearer in use reduces the shear and maximises the sliding action between a sidebearer and a wear plate located on an outrigger bracket such as 18A of the rotating connector, because the relative movement between these components is along the longitudinal axis of symmetry B of the outrigger bracket (16A/B, 18A/B) and the aligned sidebearer, and therefore the relative rotation of the wagon/s becomes easier.

As shown in FIG. 2, in the preferred embodiment of the articulated connector, the flanged outrigger brackets 16A/B, 18A/B are oriented by an angle S of 30 angle degrees between the radial line R (extending from a central rotational point C of the articulated connector) and the axial centreline X of the articulated connector 10.

Under normal working conditions and as a result of draft and buff loads as well as rock and roll and bounce, the constant contact sidebearers of the bogie 50 experience relative vertical movement or travel of typically around 6 to 8 mm, which the constant contact sidebearers are arranged to absorb. It is understood that the resultant stresses in the outrigger brackets of the described embodiment of the connector of the invention may under these normal working conditions be in the range of 250 to 550 MPa. Although the material selection for the articulated connector 10 and/or the bolster 54 may vary it should be suitable for these stresses. The specific configuration of the articulated connector described lends itself to casting and preferably the material should be suitable for casting and subsequent heat treatment.

Now that a preferred embodiment of the invention has been described in some detail it will be apparent to those skilled in the art that the articulated railway bogie connector has at least the following advantages:

i) the articulated connector itself, rather than the wagon, includes outrigger brackets which in use accommodate constant contact sidebearers and reduce the complexity of the previously known arrangements involving wear plate brackets extending from wagons themselves; and ii) the articulated connector in its preferred form operates effectively wherein the constant contact sidebearers joined in use to the articulated connector are radially aligned with those of the bogie, and in a manner so as to minimise shear therebetween.

Those skilled in the art will appreciate that the invention described herein is susceptible to variations and modifications other than those specifically described. For example, the brackets of the male and/or female connector components of the articulated connector need not be formed integral with the respective connector but rather may be mounted in any other manner to the connector, for example by bolting or otherwise fixing. Although the particular orientation and configuration of the outrigger brackets described is preferred for radial alignment, the constant contact sidebearer brackets of the articulated connector may be oriented in a variety of dispositions relative to the remainder of the connector. Any shape of bracket is also within the scope of the invention, and need not be restricted to the rectangular-faced outrigger brackets of the preferred embodiment. Any type of proprietary constant contact sidebearer can be used with the invention which is of suitable shape and performance characteristics.

All such variations and modifications are to be considered within the scope of the present invention the nature of which is to be determined from the foregoing description.

It is to be understood that, if any prior art information is referred to herein, such reference does not constitute an admission that the information forms a part of the common general knowledge in the art in any country.

The invention claimed is:

1. An articulated railway bogie connector comprising:

a male connector component adapted for mounting to an end of a railway wagon and including two outrigger brackets;

a female connector component being arranged for mating with the male component, the female component adapted for mounting to an end of an adjacent railway wagon and including another two outrigger brackets;

a wear plate that is fixed to each outrigger bracket on each of the male and female components; and constant contact sidebearers which in use are positioned such that each is in contact with a respective said wear plate and each is also mounted to a railway bogie to which the male and female connector components are pivotally mounted in use, whereby the constant contact sidebearers absorb relative vertical movement between the railway bogie connector and the railway bogie.

2. An articulated railway bogie connector as claimed in claim 1 wherein the outrigger brackets are integral with the male and/or female connector components.

3. An articulated railway bogie connector as claimed in claim 1 wherein the outrigger brackets are cast, welded or otherwise formed integral with the components.

4. An articulated railway bogie connector as claimed in claim 1 wherein the outrigger brackets are each in the form of a pair of wing members extending laterally of the respective connector components.

5. An articulated railway bogie connector as claimed in claim 4 wherein in plan view of the bogie connector and with reference to a central rotational point between the male and female connector components, each wing member is arranged to provide radial alignment between the mutually contacting wear plates and constant contact sidebearers.

6. An articulated railway bogie connector as claimed in claim 4 wherein in plan view of the bogie connector, and with reference to a radius from a central rotational point between the male and female connector components, each wing member is arranged to be lengthwise transverse to the radius.

7. An articulated railway bogie connector as claimed in claim 6 wherein each wing member has a longitudinal axis of symmetry which is orthogonal to the radius.

8. An articulated railway bogie connector as claimed in claim 1 wherein the male and/or female connector components together with the respective outrigger bracket are at least in part hollow.

9. An articulated railway bogie connector as claimed in claim 8 wherein the connector components are hollow to permit routing of pneumatic/hydraulic lines and/or electrical cable which is run internally of a centre sill of the railway wagon to which the connector component is mounted.

10. An articulated railway bogie connector as claimed in claim 1 wherein the connector components include one or more openings in side walls of said connector components.

11. An articulated railway bogie connector as claimed in claim 1 wherein the male and/or female connector components are each adapted to be welded to a skeletal body of the railway wagon.

12. An articulated railway bogie connector comprising:

a male connector component adapted for mounting to an end of a railway wagon and associated with two brackets, each adapted for fixing to a wear plate; and a female connector component being arranged for mating with the male component, the female component adapted for mounting to an end of an adjacent railway wagon and associated with another two brackets, each adapted for fixing to another wear plate, the wear plates adapted for contacting corresponding constant contact sidebearers mounted to a railway bogie to which the male and female connector components are pivotally mounted, wherein, when viewed in plan, each bracket has a longitudinal axis of symmetry which is orthogonal to a radius from a central rotational point of the articulated railway bogie connector.

13. An articulated railway bogie connector as claimed in claim 12 wherein the brackets are integral with the male and/or female connector components.

14. An articulated railway bogie connector as claimed in claim 12 wherein the brackets are cast, welded or otherwise formed integral with the components.

15. An articulated railway bogie connector as claimed in claim 12 wherein the brackets are each in the form of a pair of wing members extending laterally of the respective connector components.

16. An articulated railway bogie connector as claimed in claim 15 wherein in plan view of the bogie connector and with reference to a central rotational point between the male and female connector components, each wing member is arranged to provide radial alignment between the mutually contacting wear plates and constant contact sidebearers.

17. An articulated railway bogie connector as claimed in claim 12 wherein the male and/or female connector components together with the respective bracket are at least in part hollow.

18. An articulated railway bogie connector as claimed in claim 17 wherein the connector components are hollow to permit routing of pneumatic/hydraulic lines and/or electrical cable which is run internally of a centre sill of the railway wagon to which the connector component is mounted.

19. An articulated railway bogie connector as claimed in claim 12 wherein the connector components include one or more openings in side walls of said connector components.

20. An articulated railway bogie connector as claimed in claim 12 wherein the male and/or female connector components are each adapted to be welded to a skeletal body of the railway wagon.

* * * * *